US005970286A

United States Patent [19]

Numazu et al.

[11] Patent Number: 5,970,286

[45] Date of Patent: Oct. 19, 1999

[54] IMAGE FORMING APPARATUS AND IMAGE FORMING UNIT WITH AN IMPROVED PHASE ADJUSTMENT MEANS

[75] Inventors: Toshihiko Numazu, Sayama; Noriki Ono; Takao Yorifuji, both of Higashiyamato; Moriyuki Kouroku, Higashimurayama; Yoshiharu Abe, Tokyo; Yasushi Nakamura, Tachikawa, all of Japan

[73] Assignees: Casio ComputerCo., Ltd.; Casio Electronics Manufacturing Co., Ltd., both of Tokyo, Japan

[21] Appl. No.: 09/121,423

[22] Filed: Jul. 23, 1998

[30] Foreign Application Priority Data

Aug. 1, 1997 [JP] Japan ..... 9-208116
Jan. 12, 1998 [JP] Japan ..... 10-004189

[51] Int. Cl.[6] ..... G03G 15/00; G03G 15/01

[52] U.S. Cl. ..... 399/167; 399/75

[58] Field of Search ..... 399/36, 75, 107, 399/111, 112, 113, 116, 117, 126, 167, 159, 299

[56] References Cited

U.S. PATENT DOCUMENTS 4,796,050 1/1989 Furuta et al. ..... 399/167
5,216,475 6/1993 Ohno ..... 399/75

FOREIGN PATENT DOCUMENTS 61-156162 7/1986 Japan .
9-179372 7/1997 Japan .

*Primary Examiner*—Arthur T. Grimley
*Assistant Examiner*—Sophia S. Chen
*Attorney, Agent, or Firm*—Frishauf, Holtz, Goodman, Langer & Chick, P.C.

[57] ABSTRACT

A motor starts its rotation, and a clutch is operated to drive both of a first driving force transmission system for color printing, including drum gears, and a second driving force transmission system for monochrome printing, including a drum gear. The clutch is disengaged to stop the first system when a first sensor detects a mark on one photosensitive drum of the first system at the same time that a second sensor detects a mark on one drum driving gear of the first system. Next, when a third sensor detects a mark on another photosensitive drum of the second system at the same time that a fourth sensor detects a mark on another drum driving gear of the second system, the clutch is reengaged. Consequently, positionings of all the photosensitive body drums (drum gears) for color printing to the photosensitive drum (drum gear) for monochrome printing are performed without causing positional differences by inertia at the time of stop.

9 Claims, 8 Drawing Sheets

IMAGE FORMING APPARATUS AND IMAGE FORMING UNIT WITH AN IMPROVED PHASE ADJUSTMENT MEANS

BACKGROUND OF THE INVENTION

The present invention relates to an image forming apparatus such as a printer or a copier and an image forming unit, and more particularly relates to a color image forming apparatus and an image forming unit in which a plurality of multistage type driven sections including image carriers are arranged, and in which when the driving power is transmitted from the driving source to the driven sections through a train of gears, the phase adjustment is correctly controlled corresponding to the eccentricity of the gears.

As an example of various types of image forming apparatuses such as a printer or a copier, an electro photographic type image forming apparatus has widely been known. In such an image forming apparatus, a latent image is formed on a photosensitive member as an image carrier by photo write-in, and the latent image is changed to a toner image (development), and the developed toner image is transferred and fixed onto a sheet.

In this type of image forming apparatuses, recently, there has been the request of image formation in full color, and further, it has widely come into practice.

Such color image forming apparatuses can be divided into two major categories: the single drum type and the multistage drum type (tandem type). In the single drum type, for 1 page of sheet, in order to transfer one over the other a total of four types of toners: the respective color toners of M (magenta: red dye) toner, C (cyanogen: greenish blue) toner, and Y (yellow: yellow color) as the three primary colors of the subtractive color mixture; and K (black: black color) toner used for printing letters or the like only, the printing (image formation) processing is separately performed for each toner. Therefore, the printing process is repeated four times for 1 page of sheet, and accordingly, the printing processing requires a long time.

On the other hand, since in the tandem type, four types of toners are transferred on a sheet in order, one over the other in 1 process, the tandem type has a speed of approximately four times the processing speed of the single drum type. Therefore, recently, color image forming apparatuses with the structure of the tandem type have been used in plenty.

In such an image forming apparatus, there are a lot of sections to be driven to rotate, and to these sections to be driven to rotate, the driving force is transmitted from a motor through a driving force transmission system composed of a train of gears. Here, as a part especially requiring accuracy in rotation, there is an image carrier drum.

However, if a driving force transmission system composed of a train of gears is used for driving to rotate each driven sections represented by these drums as mentioned above, the rotational irregularity because of the eccentricity of each gear occurs in the drums. The rotational irregularity like this is not a special problem in a monochrome printer using only one color of black toner, but in a color image forming apparatus (color printer) performing printing by applying one over the other 3 colors or four colors of color toners, a difference occurs in the position of the dots (toner image elements) applied one over the other on a sheet, if there is a rotational irregularity in the drums. Usually, the printing is performed by a density of dots of approximately nine pieces in 1 mm, and for example, even if there is a positional difference of ½ dot in the colors applied one over the other, a stripe pattern called moiré occurs on the image surface, so that the quality of the image formed on the surface of a sheet may be extremely lowered.

However, since in any members, there is a limit in the manufacturing accuracy thereof, a plurality of driving gears corresponding to a plurality of three or four drums in a color printer or the like, are invariably accompanied by mechanically produced errors in shape or dimension. Accordingly, it cannot be avoided that a rotational irregularity occurs on the basis of errors in the drums driven thereby.

There are image forming apparatuses well known in Jpn. Pat. Appln. KOKAI Publication No. 61-156162 and Jpn. Pat. Appln. KOKAI Publication No. 9-179372, wherein considering the above-mentioned facts, that is, accepting the inevitable rotational irregularity, the image formation is performed while synchronizing the mutual relative image transfer positions in the image transfer sections of these plurality of drums at all times, and therefore, the gears of the same order (the same position) of the driving force transmission systems are molded by the same die to be used, in order to cancel the positional differences of the images applied one over the other.

In the image forming apparatus disclosed in Jpn. Pat. Appln. KOKAI Publication No. 61-156162, first, marks are given to the specified positions of the gears molded by the same mould or die, and from the marks, the gear ratio of a train of gears, and the clearance between the respective drums, the position where each drum is synchronized in the rotational phase at each image transfer position, is calculated, and on the basis of that, each drum gear is arranged. Consequently, the same rotational irregularity occurs in each drum in synchronism with the mutually corresponding image transfer position, but it is arranged that the transfer for each color is performed at the same position on the sheet, since the fluctuation of the moving speed of the peripheral surface relative to the image transfer position of each drum is each synchronized.

However, in the image formation, there are not only a demand for the multicolor printing, but also a demand for performing of one color printing of black, which is rather larger than the former. Accordingly, in the image forming apparatuses, there are a lot of apparatuses in which the mode can be shifted between a full color mode to perform the multicolor printing and a monochrome mode to perform one color (black) printing. In this case, usually, it is general that avoiding a method accompanied with a technical difficulty, and for easiness of achievement, even in the case of the monochrome mode, only the photo write-in driving to the photosensitive drum corresponding to the color system, is stopped, and the mechanical rotational driving is left to operate. Accordingly, the above-mentioned relative positions of the driving gears set by once performing the position fitting, do not get out of order.

However, if the mechanical driving of the color system is performed and the photosensitive drum of the color system is rotated even in printing of black only like this, since an initializing charged roller, a development roller, a cleaning blade and the like slidingly touch the photosensitive drum at all times, the members of the color system are exhausted by this sliding touch. Consequently, such a problem that though actually the color printing is not so much performed, the life of members is exhausted, occurs. The problem is solved tentatively if it is arranged that when the mode is shifted from the full color mode to the monochrome mode, both write-in driving and rotational driving are together stopped in the color system and only the black system is driven. However, if this is arranged, not only a large technical difficulty occurs in the change of the mechanical driving system, but also the following problem is derived: even if the mutually corresponding image transfer positions of the respective photosensitive drums are adjusted with efforts as mentioned above, the setting of the relative position does not coincide between the drum driving gear for black which is driven and the drum driving gear for the color which is stopped during that time, after the printing in the monochrome mode has finished.

Therefore, in the latter of Jpn. Pat. Appln. KOKAI Publication No. 9-179372, in order to solve the above-mentioned problem, in addition to the arrangement in the former of Jpn. Pat. Appln. KOKAI Publication No. 61-156162, a sensor is arranged to detect a mark of the gear. Then, two systems of driving force transmission systems which should be inevitably separated into the color and the monochrome, are separately driven, and when each sensor detects the mark, the driving force transmission system is stopped to perform positioning, so that the mutual position fitting of the two systems of driving force transmission systems may be performed, and consequently, it is arranged that when a color printing is performed next time, the synchronization of the two systems of driving force transmission systems can be achieved if these are together driven.

In the above-mentioned method of position fitting, the positioning of either of the two systems of driving force transmission systems is performed (by detecting a mark with a sensor) to stop the driving force transmission system, and next, the positioning of the other driving force transmission system is performed (similarly by detecting a mark with a sensor) to stop the driving force transmission system. By the way, generally, in the above-mentioned image forming apparatus, the sections requiring the largest torque as the mechanical torque are the drum in charge of the transfer section and the development section connected to that to be driven. For example, in a case where these are driven by a single motor together with other driven sections, 90% of the loads applied to the motor are produced in the development section and the transfer section. However, between the two systems of driving force transmission systems, the driving system joining the color printing is composed of 3 pieces of drums and the torque thereof is extremely large, but the driving force transmission system of the monochrome printing is composed of one piece of drum and the torque thereof is comparatively small. Then, in order to drive all of these at the same time, that is, in order to make it possible to correspond to the largest torque supposed to be necessary in the full color printing, a motor with a rated value to obtain a sufficient torque is used as the driving source.

The inertia (inertia, force of habit) of a motor producing a large torque like this is large corresponding to the magnitude of the produced torque. Therefore, as mentioned above, when the driving force transmission system with one piece of drum for the monochrome printing which is a driving force transmission system on one side, is driven and is stopped by a stop signal, it cannot immediately respond to the stop signal to stop instantaneously, and it stops after a somewhat long time has been elapsed, because of the above-mentioned large inertia.

Accordingly, as for the actual stop positions when the two systems of driving force transmission systems are separately driven and stopped, one position is a little ahead of the planned reference position, and the other is a little behind, so that a difference occurs between the respective positions. Therefore, such a problem that even if it is intended to perform synchronization for position fitting, actually, the two systems of driving force transmission systems mutually cause the positional difference, has been left.

By the way, the irregularity of rotational characteristics requiring the phase adjusting occurs not only in the train of gears of the driving system, but also in the photosensitive drum and the drum gear. In this case, if the photosensitive drum and the drum gear are made with an extremely high accuracy, the difference of the rotational phase does not occur, and therefore, it is only necessary to carry out the synchronization of the drum driving gears of the two systems of driving force transmission systems, as mentioned above. However, recently, it is common that the main section of the image forming members including the photosensitive drum, is unitized and is arranged in the housing of the image forming device in such a manner that attachment and removal are free. Accordingly, in order to make the photosensitive drum and the drum gear with a high accuracy, such a problem that the manufacturing cost of the unit rises considerably, is derived. For the problem, in the Jpn. Pat. Appln. KOKAI Publication No. 61-156162, a phase control means including such unitizing of the image forming members is not provided.

BRIEF SUMMARY OF THE INVENTION

The invention is made under the above-mentioned situation, and an object of the present invention is to provide an image forming apparatus and an image forming unit with a position adjustment control means for a driving force transmission mechanism, in which mutual positional differences are not produced between two systems of driving force transmission systems, and further, the unitizing can be achieved while the cost rising is restrained.

In order to achieve the above-mentioned object of the present invention, the image forming apparatus according to the present invention is arranged such that two systems of driving force transmission mechanisms composed of trains of gears driven by the same driving source, are provided, and a means for freely transmitting or cutting off a driving force of the driving source is provided to a driving force transmission mechanism on one side of the two systems, and a position adjustment control means for the driving force transmission mechanism is provided, which drives the driving force transmission mechanism on one side and stops the driving force transmission mechanism on one side when the reference position of a specified gear of the driving force transmission mechanism on one side is detected, and after that, which drives a driving force transmission mechanism on the other side and restarts the driving of the driving force transmission mechanism on one side at a specified timing while keeping the driving of the driving force transmission mechanism on the other side, when the reference position of a specified gear of the driving force transmission mechanism on the other side, is detected, and consequently, which performs the mutual position adjusting of the two systems of driving force transmission mechanisms while the two systems of driving force transmission mechanisms are driven without being stopped.

Furthermore, in order to achieve the above-mentioned object of the present invention, the image forming apparatus according to the present invention is arranged comprising: a plurality of image carrier drums which are composed of a first image carrier drum and one or more other image carrier drum, and each of which has a driven gear formed by the same mold work and given a mark including eccentricity information and made to have the same shape, and which are arranged in a line; a first driving force transmission mechanism with a first driving gear which is connected to a driven gear of the first image carrier drum, and on an end surface of which a mark including eccentricity information is given;

a second driving force transmission mechanism with one or more driving gear which is connected to a driven gear of the one or more other image carrier drum, and which is formed by the same mold work as the first driving gear, and on an end surface of which a mark including eccentricity information is given, and which is made to have the same shape; a driving source for transmitting driving force to the first driving force transmission mechanism and the second driving force transmission mechanism; a driving force shifting means for shifting the mode between a first driving force transmission mode for transmitting the driving force of the driving source only to the first driving force transmission mechanism, and a second driving force transmission mode for transmitting the driving force of the driving source to both the first driving force transmission mechanism and the second driving force transmission mechanism; a first detection means for detecting a home position of the first driving gear through a mark of the first driving gear; a second detection means for detecting, through a mark of a driving gear of the second driving force transmission mechanism, a home position of the driving gear; a first image formation mode execution means for operating an image forming means acting on the first image carrier drum corresponding to the first driving force transmission mode; a second image formation mode execution means for operating an image forming means acting on the plurality of image carrier drums corresponding to the second driving force transmission mode; and a driving force transmission mechanism control means which controls practice and stoppage of the second image formation mode after position adjustment of the second driving force transmission mode has been performed, in such a way that the driving force shifting means is first shifted to the second driving force transmission mode to operate the driving force transmission mechanism, and responding to detection of a home position by the second detection means, the driving force shifting means is shifted to the first driving force transmission mode, and after that, responding to detection of a home position by the first detection means, the driving force shifting means is again shifted to the second driving force transmission mode.

The image forming apparatus according to the present invention arranged as mentioned above, further comprises: a first driven gear detection means for detecting, through a driven gear of the first image carrier drum, a home position of the driven gear; and a second driven gear detection means for detecting through a driven gear of the one or more other image carrier drum, a home position of the driven gear, and the driving force transmission mechanism control means is arranged to judge that a reference position of the second driving force transmission mechanism is detected, when the detection of a home position of the second driving gear by the second detection means coincides with the detection of a home position of the second driven gear by the second driven gear detection means, while the driving corresponding to the least common denominator of the number of teeth of a second driving gear and the number of teeth of a second driven gear, is continued in the second driving force transmission mode, and is arranged to judge that a reference position of the first driving force transmission mechanism is detected, when the detection of a home position of the first driving gear by the first detection means coincides with the detection of a home position of the first driven gear by the first driven gear detection means, while the driving corresponding to the least common denominator of the number of teeth of a first driving gear and the number of teeth of a first driven gear, is continued in the driving in the first driving force transmission mode. Furthermore, the plurality of image carrier drums are supported to be surrounded by casings, respectively, and compose a plurality of image forming units which can freely be attached and removed in a housing including a sheet carrying passage of the image forming apparatus at specified positions along the sheet carrying passage, and it is arranged that a driven gear of an image forming unit corresponding to the first image carrier drum is mounted on the image forming apparatus to be connected to the first driving gear of the first driving force transmission mechanism, and each driven gear of an image forming unit corresponding to the one or more other image carrier drum is mounted on the image forming apparatus to be connected to a driving gear of the second driving force transmission mechanism, respectively. Furthermore, it is preferable that the plurality of driving gears and the plurality of driven gears are composed of helical gears, respectively.

In order to achieve the above-mentioned object of the present invention, the image forming unit according to the present invention can freely be attached to and removed from a specified position in a housing including a sheet carrying passage of the image forming apparatus, along the sheet carrying passage, and it comprises: an image carrier drum with a driven gear which is connected to a driving gear of a driving force transmission mechanism installed in the image forming apparatus when mounted in the image forming apparatus and to which a mark including eccentricity information is applied; and a casing for supporting the image carrier drum to be surrounded, wherein the casing has an opening portion for detecting the mark from the outside of the casing through that.

The image forming unit according to the present invention arranged as mentioned above, is composed of a first unit which contains the image carrier drum and the casing with an opening portion and a second unit which can be united with the first unit and contains a development means for forming a toner image on the image carrier drum and a development casing for supporting the development means to be surrounded, wherein the development casing has an extending portion facing the opening portion when united with the first unit, and in the extending portion, an opening for detecting the mark from the outside of the extending portion, is formed corresponding to the opening portion. Furthermore, the image forming unit according to the present invention arranged as mentioned above, is arranged so that a plurality of pieces may be put in order in the housing, and the mark is provided for detecting a home position of the driven gear so that a driven gear of each image forming unit may be located, mutually having a specified relationship. Furthermore, it is preferable that the plurality of driving gears and the plurality of driven gears are composed of helical gears, respectively.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The above-mentioned one and other aspects of the present invention will be explained in the following detailed description by referring to the accompanying drawings.

One embodiment and other embodiments of the present invention will be described below by referring to the accompanying drawings.

DETAILED DESCRIPTION OF THE INVENTION

Figure 1:
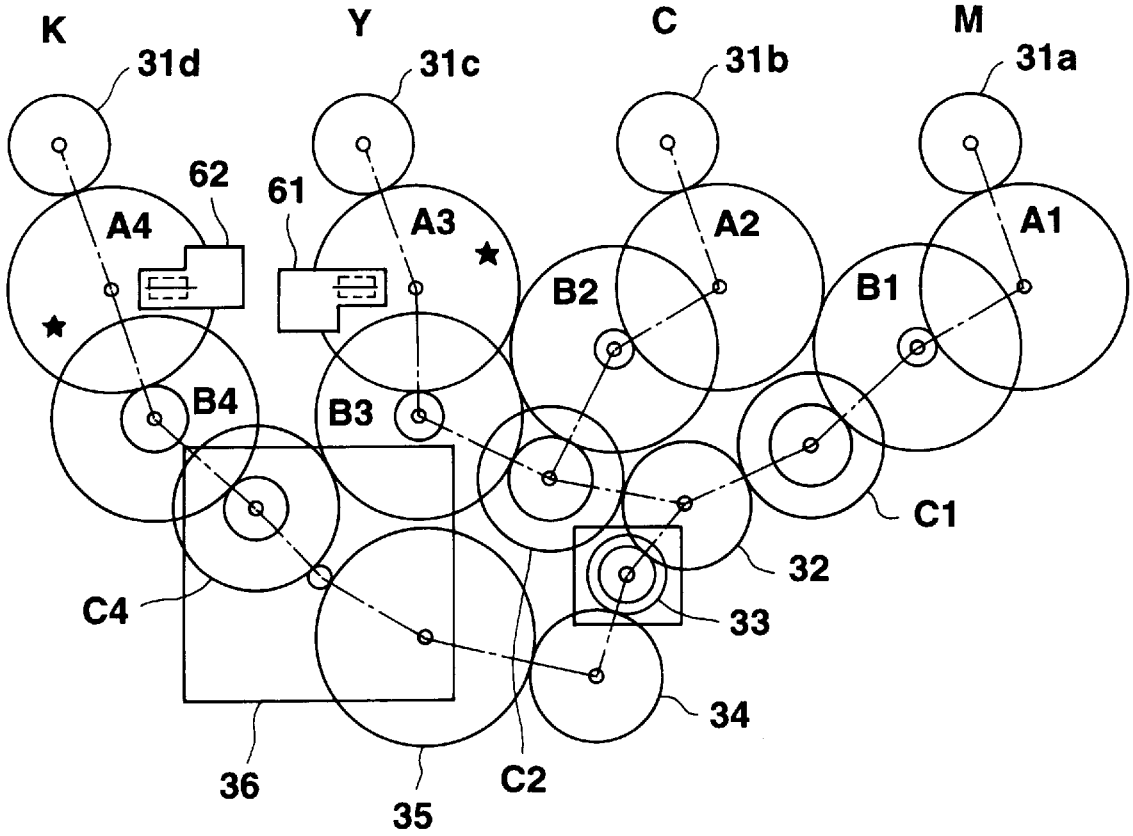
FIG. 1 is a side view showing the structure of the driving force transmission system of a multicolor image forming apparatus (color printer) according to one embodiment of the present invention.
Figure 2:
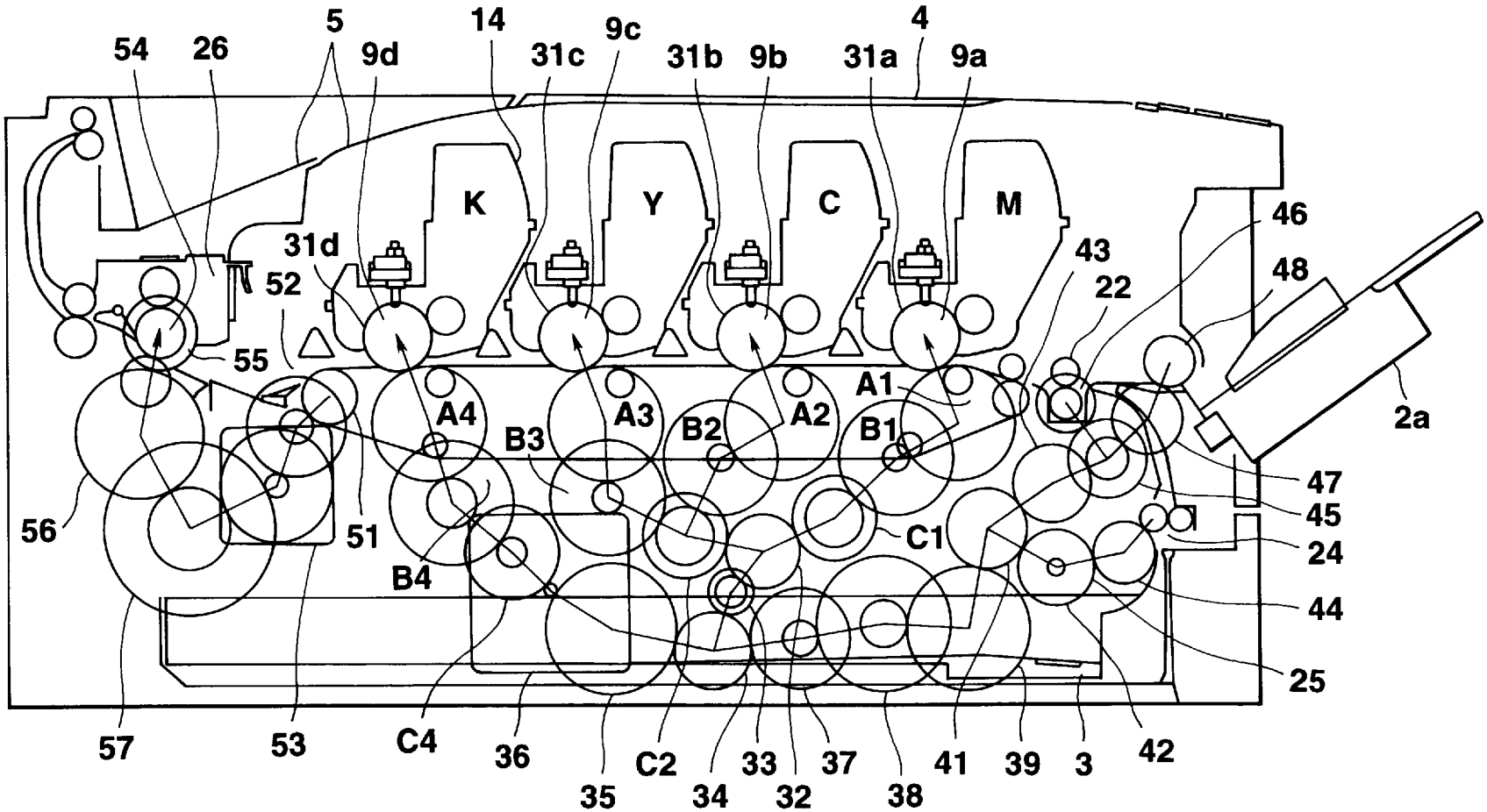
FIG. 2 is a side cross-sectional view of a multicolor image forming apparatus according to one embodiment of the present invention.
Figure 3:
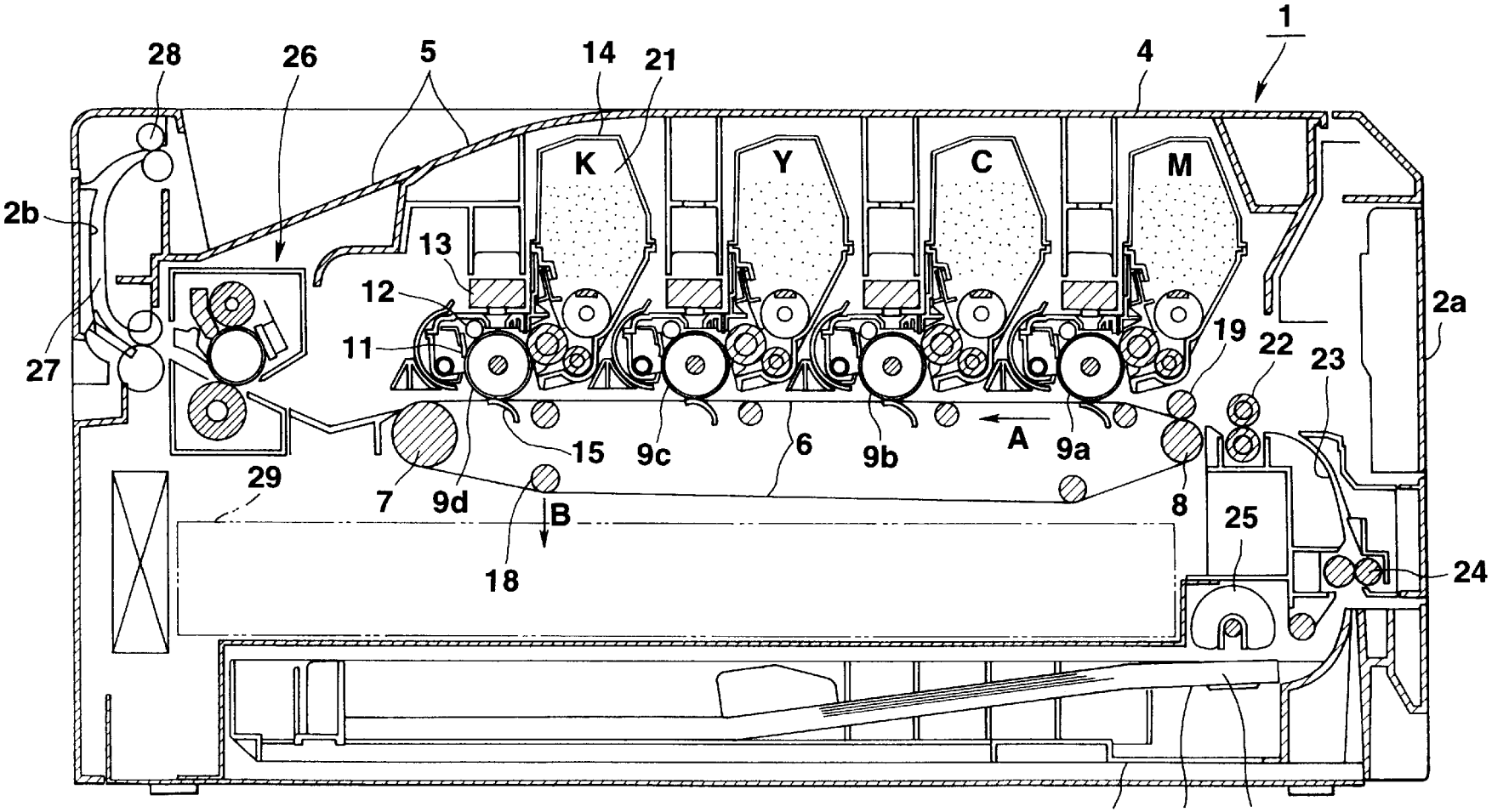
FIG. 3 is a side cross-sectional view typically showing the internal structure of a multicolor image forming apparatus according to one example of the present invention, omitting the structure of the driving force transmission system.
Figure 4:
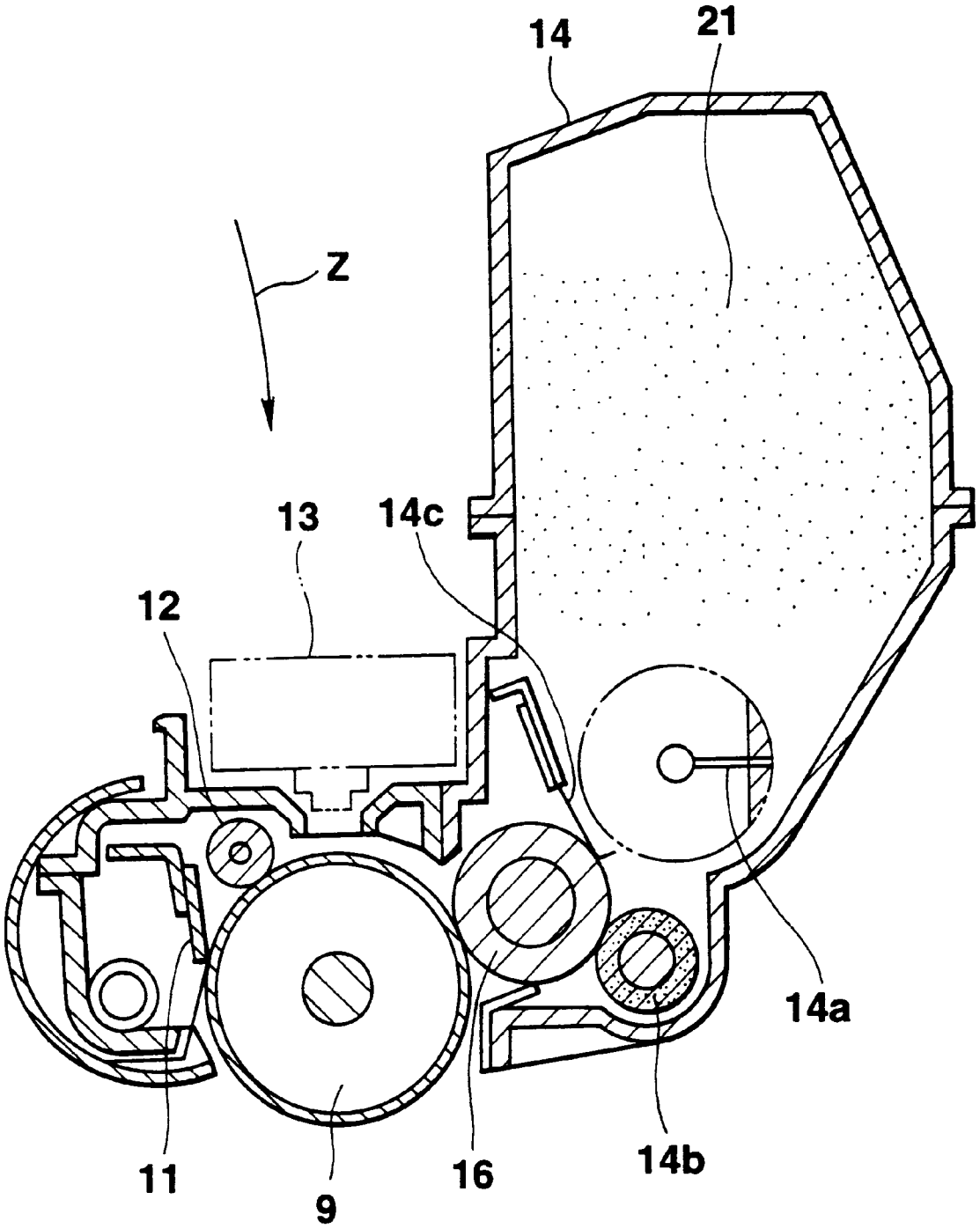
FIG. 4 is a side cross-sectional view of the main portion (image forming unit) of the image forming members of a multicolor image forming apparatus according to one example of the present invention.

At first, a tandem type color printer as an image forming apparatus according to one embodiment of the present invention will now be described with reference to FIGS. 1 to 4, wherein FIG. 1 is an enlarged side view schematically showing a structure of a driving force transmission system of the color printer, FIG. 2 is a vertical cross sectional view schematically showing a structure of the color printer including the structure of the driving force transmission system shown in FIG. 1, FIG. 3 is an enlarged vertical cross-sectional view merely showing the structure of the color printer excluding the structure of the driving force transmission system, and FIG. 4 is a vertical cross-sectional view of one of four image forming units of the color printer.

As shown in FIG. 3, the color printer 1 comprises an auxiliary paper sheet feed tray 2*a* mounted on a front wall of an outer housing of the printer to be swingable between a horizontal opening position and a vertical closed position, and further comprises an auxiliary paper sheet discharge tray 2*b* mounted on a rear wall of the outer housing to be swingable between a horizontal opening position and a vertical closed position. At a lower portion of the outer housing, a paper sheet cassette 3 is mounted to be detachable through the front wall. The cassette 3 includes a vertically movable plate 3-1 urged upwardly by urging means not shown, and a plurality of paper sheets P are laid on the movable plate. A top portion of the outer housing is structured as an upper cover 4 to be swingable around a rear end portion thereof between a horizontal closed position and a vertical opening position. On one side portion of a front end region of an upper surface of the upper cover 4, a power switch, a liquid display device, a plurality of input keys, etc. are arranged. A rear end region of the upper surface of the upper cover 4 is shaped as an upper main paper sheet discharge tray 5.

At a center of the housing a paper sheet conveyor belt 6 is arranged to be extended in back and forth directions, and both ends of the belt 6 are suspended on a driving roller 7 and a following roller 8 so that the belt is circulated in a counter-clockwise direction as indicated by an arrow A.

Along an upper extending portion of the belt 6, four photosensitive drums 9 (9*a*, 9*b*, 9*c*, and 9*d*) of four image forming units are arranged along a moving direction of the upper extending portion. Around each of the photosensitive drum 9, each image forming unit includes a cleaner 11, an initializing electric charging roller 12, a writing head 13, a developer 14, and a transfer sheet 15 are arranged. As shown in FIG. 4, the developer 14 includes a toner stirrer 14*a*, a toner supply roller 14*b*, a doctor blade 14*c*, and a developing roller 16. The first developer 14 arranged in a most upstream position along the moving direction of the upper extending portion of the belt 6, contains toner 21 of magenta (M) color, the second developer 14 arranged in a secondly upstream position along the moving direction, contains toner 21 of cyan (C) color, the third developer 14 arranged in a thirdly upstream position along the moving direction, contains toner 21 of yellow (Y) color, and the fourth developer 14 arranged in a most downstream position along the moving direction, contains toner 21 of black (K) color.

The writing heads 13 are supported by the upper cover 4 so that the writing heads 13 are moved upward and downward by the vertical swing of the upper cover 4. When the upper cover 4 is swung from the vertical opening position to the horizontal closed position, the writing heads 13 are moved downward as shown by an arrow Z and arranged above and near to the photo-sensitive drums 9*a*, 9*b*, 9*c*, and 9*d*so that they can work as recording portions. The developing rollers 16 are arranged in lower openings of the developers 14 and are in contact with outer peripheries of the photo-sensitive drums 9*a*, 9*b*, 9*c*, and 9*d* so that they can work as developing portions. And the transfer sheets 15 are arranged to face the lower ends of the outer peripheries of the photosensitive drums 9*a*, 9*b*, 9*c*, and 9*d* with the upper extending portion of the belt 6 being interposed therebetween, and urge the upper extending portion of the belt 6 upwardly to press the upper extending portion on the lower ends of the outer peripheries of the photosensitive drums 9*a*, 9*b*, 9*c*, and 9*d*, so that they can work as transfer portions.

The belt 6 is applied with a suitable tension by tension rollers 18 urging an inner surface of a lower extending portion of the belt 6 downwardly as indicated by an arrow B shown in FIG. 3.

With an upstream end of the upper extending portion of the belt 6, an adhering roller 19 is in contact to work as a paper sheet introducing portion. In front of the following roller 8 a waiting roller pair 22 is arranged, a paper sheet supply guide 23 is extended downward from the waiting roller pair 22, and a paper sheet supply roller pair 24 is arranged at a lower end of the paper sheet supply guide 23. The paper sheet supply roller pair 24 is also arranged above an upper-front end of the paper cassette 3, and is in adjacent to a paper sheet pick up roller 25.

From a downstream end of the upper extending portion of the belt 6, a paper sheet discharge guide 27 is extended through the auxiliary paper sheet discharge tray 2*b* toward the main paper sheet discharge tray 5. A fixing device 26 is arranged along the paper sheet discharge guide 27 between the downstream end of the upper extending portion of the belt 6 and the auxiliary paper sheet discharge tray 2*b*, and a paper sheet discharge roller pair 28 is arranged at a discharge end of the paper sheet discharge guide 27. The fixing device 26 includes a box of heat resisting property in which a press roller, a heating roller, a separating blade, a periphery cleaner, an oil painting roller, a temperature measuring device, etc. are arranged.

Furthermore, an electric portion 29 is arranged in the outer housing of the color printer 1 between the paper sheet conveyor belt 6 and the paper sheet cassette 3. The electric portion 29 includes at least one circuit board on which a plurality electric or electronic parts are mounted to form a control unit for controlling the color printer 1.

When the power switch is turned on and various data needed to print a desired image on a paper sheet by this printer 1 is input into the control unit through the input keys or is supplied from a host device such as a host computer, the various data including a quality of the paper sheet used to be printed the desired image in this printer 1, the number of the paper sheet used to be printed the desired image, and a printing mode used to print the desired image in this printer 1, the color printer 1 starts to print the desired image on the paper sheet of the selected quality and in the selected number.

At first at each rotation of the paper sheet pick up roller 25, the pick up roller 25 picks up an upper most one of the paper sheets contained in the paper sheet cassette 3 to supply the picked up paper sheet to the paper sheet supply roller pair 24. The supply roller pair 24 supplies the picked up paper sheet to the waiting roller pair 22, and the waiting roller pair 22 stops the movement of the picked up paper sheet to the paper sheet introducing portion on the upstream end of the upper extending portion of the belt 6 and correct a skew of the picked up paper sheet.

At the same time when the pick up roller 25 starts its rotation, the driving roller 7 starts its rotation to circulate the belt 6 in the counterclockwise direction, and each photosensitive drum 9 and the developing roller 16 corresponding thereto start their rotation.

The initializing charging roller 12 applies evenly high minus electric charges on the outer periphery of the photosensitive drum 9 corresponding thereto, and the writing head 13 exposes the charged periphery with a light in accordance with an image signal from the control unit to form a latent image formed by a low minus electric charge portion lowered in charge by the exposure in an initialized high minus electric charge portion. And, the developing roller 16 of the developer 14 develops the low minus electric charge portion of the latent image with the toner to form a toner image on the outer periphery of the photosensitive drum 9.

The waiting roller pair 22 starts its rotation to supply the paper sheet so that a printing start position on the paper sheet will reach at the transfer portion of the image forming unit at the most upstream position when a leading end of the toner image on the photosensitive drum 9*a* at the most upstream position will reach at the transfer portion of the image forming unit at the most upstream position. The adhering roller 19 presses the paper sheet on the upper extending portion of the belt 6 while the roller 19 being applying an adhering bias on the paper sheet, so that the paper sheet is electrostatically adhered on the upper extending portion. The paper sheet is conveyed to the first transfer portion between the most upstream photosensitive drum 9*a* and the most upstream transfer sheet 15. The transfer sheet 15 applies a transfer electric current output from a transfer bias current source not shown on the paper sheet thorough the upper extending portion of the belt 6, so that the toner image of the magenta color (M) on the photosensitive drum 9*a* is transferred to the paper sheet. Next, at the second transfer portion between the second upstream photosensitive drum 9*b* and the second upstream transfer sheet 15 the toner image of the cyanogen color (C) on the photosensitive drum 9*b* is transferred to the paper sheet, further at the third transfer portion between the third upstream photosensitive drum 9*c* and the third upstream transfer sheet 15 the toner image of the yellow color (Y) on the photosensitive drum 9*c* is transferred to the paper sheet, and finally at the fourth transfer portion between the fourth upstream or downstream photo-sensitive drum 9*d* and the fourth upstream or downstream transfer sheet 15 the toner image of the black color (K) on the photosensitive drum 9*d* is transferred to the paper sheet. However, it is need not to transfer the images of said all colors to the paper sheet at any time, and the image finally formed on the paper sheet may be formed by at least one of the four colors or by any combination of the four colors. The paper sheet on which the image of the desired color or colors is formed is separated from the upper extending portion of the belt 6 at its downstream end, and is passed through the fixing device 26 at which the image formed on the paper sheet is fixed on the paper sheet by heat applied from the fixing device 26. The paper sheet passed through the fixing device 26 is discharged on the auxiliary paper sheet tray 2*b* with the image facing upward when the auxiliary paper sheet tray 2*b* is turned backward and arranged at its horizontal open position, and the paper sheet passed through the fixing device 26 is discharged on the main paper sheet tray 5 with the image facing downward by the discharge roller pair 28 when the auxiliary paper sheet tray 2*b* is turned upward and arranged at its vertical closed position.

A driven portion of each of the driving roller 7, the photosensitive drums 9*a*, 9*b*, 9*c*, and 9*d*, the waiting roller pair 22, the paper sheet supply roller pair 24, the paper sheet pick up roller 25, and the fixing device 26, is engaged with the driving force transmission system shown in FIG. 2 and is rotatably driven by the system. The system comprises of a gear train in this embodiment. Each developing roller 16 is coupled to a drum gear of the photosensitive drum 9 corresponding thereto and is indirectly driven by the gear train, and the paper sheet discharge roller pair 28 is coupled to the fixing device 26 and is indirectly driven by the gear train.

As shown in FIG. 2, each of the drum gear 31 (31*a*, 31*b*, 31*c*, and 31*d*) is integrally connected to one end of each of the photosensitive drums 9 (9*a*, 9*b*, 9*c*, and 9*d*), and the drum gears are engaged with drum driving gears A1, A2, A3, and A4, respectively. Further, these drum driving gears A1, A2, A3, and A4 are engaged with small diameter gears of third reduction gear units B1, B2, B3, and B4, respectively. The third reduction gear units B1, B2, B3, and B4 further have large diameter gears coaxial with the small diameter gears. The large diameter gear of the third reduction gear unit B1 is engaged with a small diameter gear of a second reduction gear unit C1, and the large diameter gears of the third reduction gear units B2 and B3 are engaged with a small diameter gear of a second reduction gear unit C2. These second reduction gear units C1 and C2 have large diameter gears, and these large diameter gears engage with one clutch gear 32. The clutch gear 32 is connected through an idler gear 56 and a reduction gear 57 with a driving shaft gear of a drum driving motor 36 through a first reduction gear 33, and idler gears 34 and 35.

The drum gears 31 (31*a*, 31*b*, 31*c*, and 31*d*) are formed through one mold or die, and have the same shape and the same dimensions as to each other. And, the third reduction gear units B1, B2, B3, and B4 are formed through another mold or die, and have the same shape and the same dimensions as to each other. Further, the second reduction gear units C1, C2, C3, and C4 are formed through the other one mold or die, and have the same shape and the same dimensions as to each other. Therefore, rotation characters transferred to the third reduction gear units B1, B2, and B3 from the second reduction gear units C1 and C2 both of which are driven by the driving force from the drum driving motor 36 through the idler gears 35 and 34, and the first reduction gear 33 are the same as to each other. Further, a rotation character transferred to the first photosensitive drum 9*a* from the third reduction gear unit B1 through the drum driving gear A1, a rotation character transferred to the second photosensitive drum 9*b* from the third reduction gear unit B2 through the drum driving gear A2, and a rotation character transferred to the third photosensitive drum 9*c* from the third reduction gear unit B3 through the drum driving gear A3 are the same as to each other.

A further second reduction gear unit C4 is interposed between the third reduction gear unit B4 corresponding to the fourth photosensitive drum 9*d* and the drum driving motor 36. The further second reduction gear unit C4 has a large diameter gear and a small diameter gear coaxial to each other, and the large diameter gear is engaged with the driving shaft gear of the drum driving motor 36 and the small diameter gear is engaged with the large diameter gear of the third reduction gear B4.

In this driving force transmission system, gear ratios between the idler gears 35, 34, and 33 are so set that a rotation character transferred to the fourth photosensitive drum 9*d* from the second reduction gear unit C4 through the third reduction gear unit B4 and the drum driving gear A4 is the same as each of the rotation characters transferred to the fourth photosensitive drums 9*a*, 9*b*, and 9*c* from the second reduction gear units C1 and C2 through the third reduction gear unit B1 and the drum driving gear A1, the third reduction gear unit B2 and the drum driving gear A2, and the third reduction gear unit B3 and the drum driving gear A3.

The idle gear 34 is engaged with a reduction gear 37 which is engaged with another reduction gear 38. The another reduction gear 38 is engaged with an idler gear 39 which is engaged with another idler gear 41. The another idler gear 41 is engaged with two idler gears 42 and 43. One idler gear 42 is connected to the pick up roller 25 through a clutch not shown, and is connected to the supply roller pair 24 through an idler gear 44. The another idler gear 43 is connected to a small diameter gear of a double gear unit 45 for increasing rotation speed and for transferring rotation force. A large diameter gear of the double gear unit 45 is connected to a clutch gear 46 which is engaged with the waiting roller pair 22 (in this case, the double gear unit 45 works as a rotation speed increasing gear). A small diameter gear of the double gear unit 45 is engaged with an idler gear 47 (in this case, the double gear unit 45 works as a transferring gear), and the idler gear 47 is engaged with a gear 48 of an auxiliary paper supply roller which is not shown but is located near to a swingable center or a lower end of the auxiliary paper supply tray 2*a*. The auxiliary paper supply roller is used to supply a paper sheet on the auxiliary paper supply tray 2*a* into the paper sheet supply guide 23 while the tray 2*a* is located at its horizontal open position.

A gear 51 of the driving roller 7 for driving the paper sheet conveyor belt 6 is connected to a driving shaft gear of a belt driving motor 53 through a reduction gear 52. The driving shaft gear of the belt driving motor 53 is connected to a heating roller gear 55 fixed to a heating roller 54 of the fixing device 26. Therefore, the conveyor belt 6 and the fixing device 26 are driven at the same time.

According to the above described structure, since the gears or gear units arranged at the same positions as to each other in the gear train are formed by using the same mold or die as to each other to have the same shape and the same dimensions as to each other, the transmission ratios in the gear train can be set on the basis of positional relationships between the photosensitive drums 9 in the gear train to make the rotation characters of the photosensitive drums 9 on the image transfer portions caused by the rotational force transmission from the drum driving motor 36 to the photosensitive drums 9 through the gear train, being the same as to each other.

FIG. 1 shows one driving force transmission system for the drum gears 31*a* to 31*c* of the first to third photosensitive drums 9*a* to 9*c* and another driving force transmission system for the drum gear 31*d* of the fourth photosensitive drum 9*d*. The one driving force transmission system includes a gear train having the gears and the gear units arranged between the drum gears 31*a* to 31*c* and the clutch gear 32 which is driven by the drum driving motor 36 through the two idle gears 35 and 34 and the first reduction gear 33, and the another driving force transmission system includes a gear train having the gears and the gear units arranged between the drum gear 31*d* and the further second reduction gear C4 which is directly driven by the drum driving motor 36.

And while an image of monochrome is formed on the paper sheet by this printer 1, the former driving force transmission system for the first to third photo-sensitive drums 9*a* to 9*c* is stopped and the latter driving force transmission system for the fourth photosensitive drum 9*d* is only operated. Therefore, the rotation character of the fourth photosensitive drum 9*d* becomes different from each of the rotation characters of the first to third photosensitive drums 9*a* to 9*c* in an angular direction.

When the color printer 1 is restarted to do its operation after it has been stopped its operation, an operation for canceling the difference between the rotation character of the fourth photosensitive drum 9*d* and each of the rotation characters of the first to third photosensitive drums 9*a* to 9*c* in the angular direction must be done whether the last operation of the printer 1 was for the image formation of the monochrome color or for the image formation of the full color, so that if the image formation of the full color is performed it will be done without positioning error of each color image.

In this embodiment, one mark (star mark in FIG. 1) is provided at a predetermined position on an outer side surface of the third drum driving gear A3, and another mark (star mark in FIG. 1) is provided at a predetermined position on an outer side surface of the fourth drum driving gear A4. Two sensors 61 and 62 for detecting the two marks are provided on a fixed frame (not shown) of the printer 1. A positional relationship between the two marks and the two sensors 61 and 62 is so set that the fourth photosensitive drum 9*d* is located at its standard position when the sensor 62 senses the mark on the fourth photosensitive drum 9*d* and the third photosensitive drum 9*c* is located at its standard position when the sensor 61 senses the mark on the third photosensitive drum 9*c*. And, as is apparent from the above description, the first and second photosensitive drums 9*a* and 9*b* are located at their standard positions when the third photosensitive drum 9*c* is located at its standard position.

Therefore, when the third drum driving gear A3 and the fourth drum driving gear A4 are synchronized with each other in their rotation characters, the four drum driving gears A1 to A4 are inevitably synchronized with each other in their rotation characters.

However, since an inertial mass of the one driving force transmission system for the first to third drum driving gears 31*a* to 31*c*, that is the first to third photosensitive drums 9*a* to 9*c*, is different from an inertial mass of the another driving force transmission system for the fourth drum driving gear 31*d*, that is the fourth photosensitive drum 9*d*, the four drum driving gears A1 to A4 are not actually synchronized with each other in their rotation characters only by stopping the operation of the one driving force transmission system when the one sensor 61 senses the mark of the third photosensitive drum 9*c* and by stopping the operation of the another driving force transmission system when the another sensor 62 senses the mark of the fourth photosensitive drum 9*d*.

In order to clear this problem, in this embodiment, at first the two driving force transmission systems for the first to third photosensitive drums 9*a* to 9*c* and for the fourth photosensitive drum 9*d* are driven at one time by the drum driving motor 36 through the clutch gear 32. And, when the sensor 61 senses the mark on the third photosensitive drum 9*c*, the clutch gear 32 is once disconnected not to transmit the rotation force from the drum driving motor 36 to the one driving force transmission system for the first to third photo-sensitive drums 9*a* to 9*c* and to stop the one driving force transmission systems. Next, after the sensor 62 senses the mark on the drum driving gear A4 in the another driving force transmission system for the fourth photosensitive drum 9*d* to which the clutch gear 32 is transmitting the rotation force, the clutch gear 32 is connected again at a predetermined timing (in this embodiment, just after the sensor 62 senses the mark) to transmit the rotation force from the drum driving motor 36 to the one driving force transmission system for the first to third photosensitive drums 9*a* to 9*c* and to drive the one driving force transmission system. That is, the mark on the fourth drum driving gear A4 is sensed by the sensor 62 while the another driving force transmission system for the fourth photosensitive drum 9*d* is operating but the one driving force transmission system for the first to third photosensitive drums 9*a* to 9*c* is not operated, and the operation of the one driving force transmission system for the first to third photosensitive drums 9*a* to 9*c* is restarted when the mark on the fourth drum driving gear A4 is sensed by the sensor 62. This means that the operation of the one driving force transmission system for the first to third photosensitive drums 9*a* to 9*c*, all the drum driving gears A1 to A3 for the first to third photosensitive drums 9*a* to 9*c* in the one driving force transmission system having been arranged at their standard positions, is restarted with the reach of the drum driving gear A4 for the fourth photosensitive drum 9*d* to its standard position.

In this condition, while the paper sheet supplied through the pick up roller 25 and the paper sheet supply roller pair 24 and laid on the belt 6 is conveyed by the belt 6, a full color printing of image is performed on the belt 6. As described above, since all the rotations of the photosensitive drums 9*a*, 9*b*, 9*c*, 9*d* are synchronized with each other while the inertia of the one rotation force transmission system for the first to third photosensitive drums 9*a* to 9*c* and the inertial of the another rotation force transmission system for the fourth photosensitive drum 9*d* are different from each other, the four images of the four colors can be transferred to their predetermined positions on the paper sheet conveyed by the belt 6 without causing positional errors owing to the difference in the rotation characters of the gears and the gear units in the gear trains of the rotation force transmission systems.

The color printer 1 has two printing modes in one of which a normal printing speed for printing an image on a normal paper sheet is set and in another of which a slow printing speed for printing an image on a transparent sheet which is used in an Over Head Projector is set. Therefore, it is preferable that the initial position adjustments for all of the first to fourth drum driving gears A1 to A4 to be performed just after the power switch is turned on is performed in the low speed printing mode, so that an effect of the difference in the inertias on the position adjustments is weakened and a more further good result can be obtained.

In the above described embodiment, the standard position of each of the photosensitive drums 9 is sensed by the sense of the standard position of the drum driving gear A3 or A4 through the sense of the mark on the drum driving gear A3 or A4 by the sensor 61 or 62. A difference in rotation characters which needs to such positional adjustments as described above is produced not only in the gear train of the above described rotational force transmission system but also in the photosensitive drums and in the drum gears. Of course since all of the photosensitive drums (that is, the drum gears) and all of the drum driving gears are assembled with each other in a factory to make their rotations being synchronized with each other, no difference in rotation angle positions of the predetermined standard positions of the first to third photosensitive drums 9*a* to 9*c* which belongs to the same rotational force transmission system will not occur. But, a rotation angle position of the predetermined standard position of the fourth drum gear 31*d* will be different from the rotation angle position of the predetermined standard position of the third drum gear 31*c* after only the fourth photosensitive drum 9*d* is driven for printing an image of the monochrome color because the number of the teeth of the fourth drum driving gear 31*d* is different from the number of the teeth of the third drum driving gear 31*c* and/or the number of the teeth of the fourth drum gear 31*d* is different from the number of the teeth of the third drum gear 31*c*.

If the photosensitive drums and the drum gears are formed with high precision, no difference in the rotation angle positions of the predetermined standard positions of these drums and/or the drum gears will occur after the rotation angle position of the predetermined standard position of the fourth drum driving gear A4 and the rotation angle position of the predetermined standard position of the third drum driving gear A3 are once adjusted to make them coincident with each other. However, if the photosensitive drums and the drum gears are formed with high precision, a manufacturing cost for manufacturing them becomes very large. If the difference in the rotation characters of the photosensitive drums, that is those of the drum gears, is cancelled, the drum gears may be manufactured with the same precision as that used in manufacturing of the other gears in the gear train of the rotation force transmission system, so that the manufacturing cost of the drum gears can be reduced. This is particulary advantageous in that the image forming units are so structured as to be detachable to the other of the printer 1 and to be a disposable type.

Figure 5:
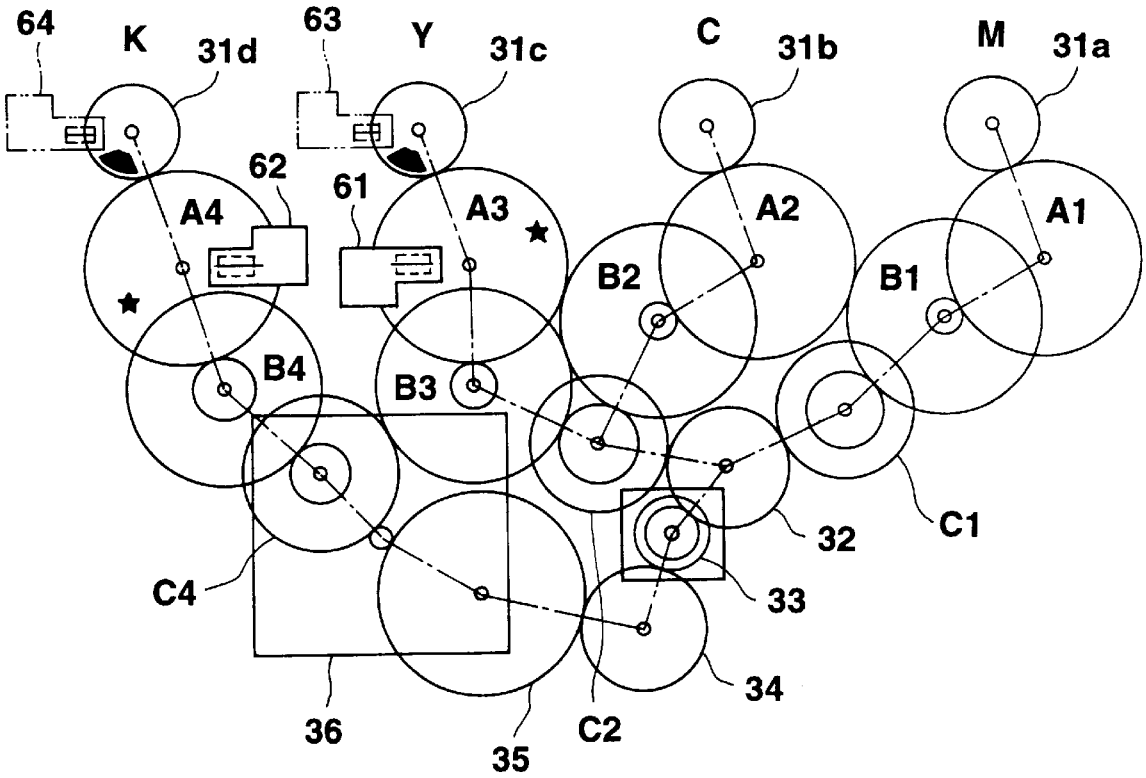
FIG. 5 is a side view showing the structure of the driving force transmission system of a multicolor image forming apparatus according to another embodiment of the present invention.

FIG. 5 is a side view showing a structure of a driving force transmission mechanism of an image forming apparatus according to another embodiment of the present invention, which can cancel a difference in rotation characters of drum gears of the transmission mechanism. In FIG. 5, structural elements which are the same as the structural elements in FIG. 1 are designated by reference numerals which are the same as those designating the same structural elements in FIG. 1. And a structure of a multi-color image forming apparatus to which the driving force transmission mechanism of the another embodiment is applied, is the same as the structure of the multi-color image forming apparatus to which the driving force transmission mechanism of the above described one embodiment. In the another embodiment shown in FIG. 5, marks which are described in detail later are provided on predetermined positions on the drum gear 31*c* and 31*d* of the third and fourth photo-sensitive drums 9*c* and 9*d*, and two sensors 63 and 64 for sensing the marks are provided on a frame (not shown) of the printer 1.

Figures 6A, 6B:
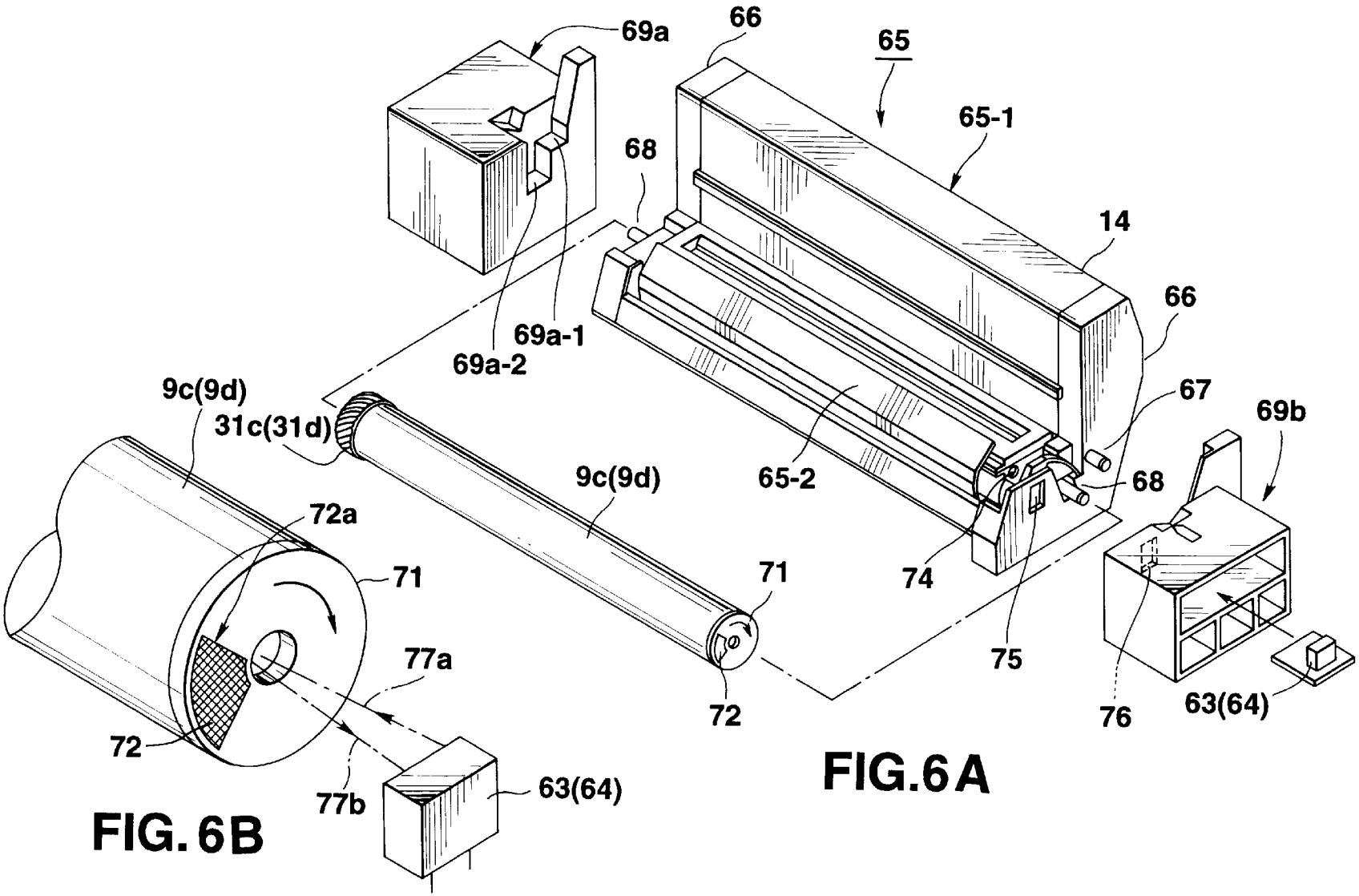
FIG. 6A is a partly exploded illustration showing the arrangement of the image forming unit, the mark of the photosensitive drum, and the sensor for detecting the mark, according to one embodiment of the present invention.
FIG. 6B is a partly enlarged figure of the mark of the photosensitive drum and the detection sensor in FIG. 6A.

FIG. 6A is a partially exploded perspective view of the third (fourth) image forming unit including the third (fourth) photosensitive drum 9*c* (9*d*) and one sensor 63 (64), wherein the mark provided on the flange of the third (fourth) photosensitive drum 9*c* (9*d*) is shown. And, FIG. 7 is an exploded perspective view showing an image forming unit 65 which is as a representative of the first to fourth image forming units from the image forming apparatus of this embodiment, wherein the image forming unit 65 is exploded into two sub-units.

Figure 7:
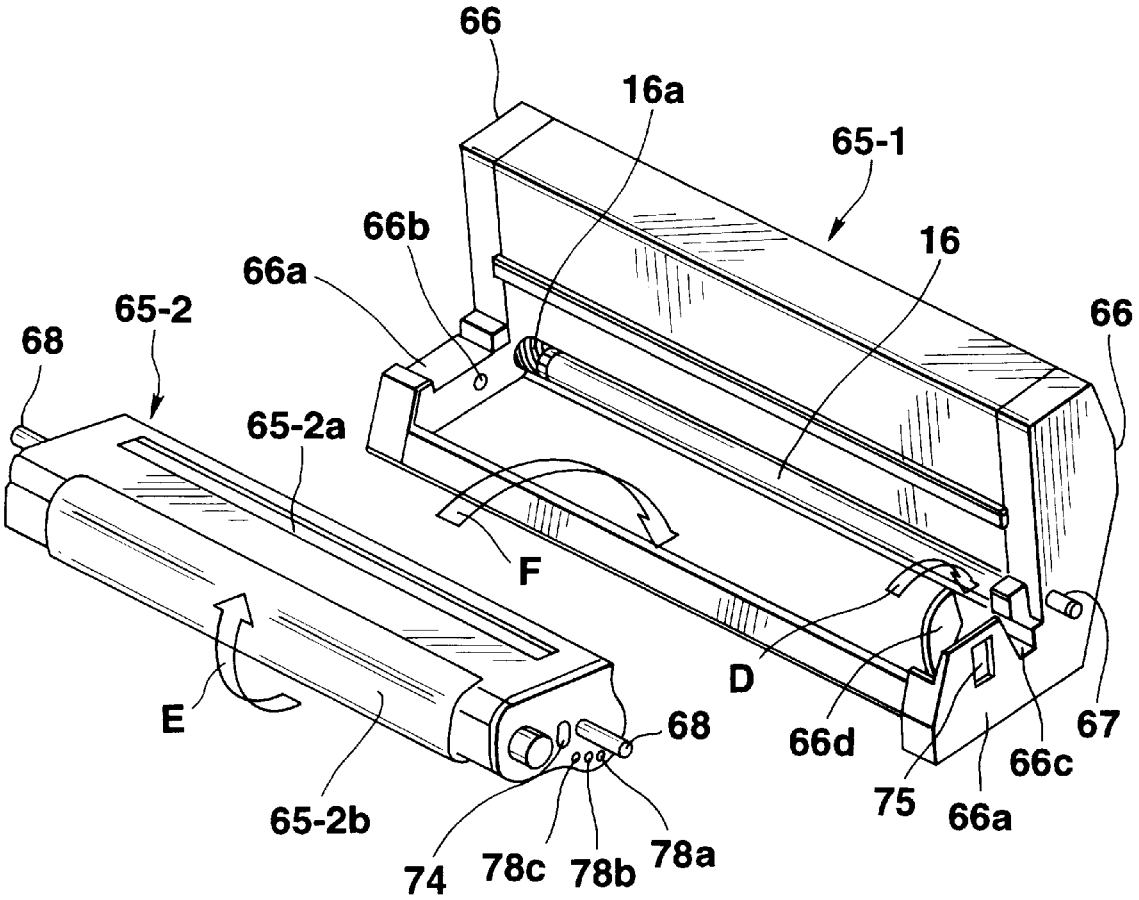
FIG. 7 is an illustration showing the state where the image forming unit is divided into a drum unit and a development unit, according to one example of the present invention.

As shown in FIG. 7, the image forming unit 65 comprises of two subunits one of which is a developing subunit 65-1 and another of which is a drum subunit 65-2. The developing subunit 65-1 is provided with a subunit frame 66 also used as a toner container, the toner stirrer 14*a*, the toner supply roller 14*b*, the developing roller 16, and the doctor blade 14*c*, these members 14*a*, 14*b*, 16, and 14*c* excluding the subunit frame 66 having been described with reference to FIG. 4. From right and left ends of a lower end region of the frame 66, a pair of extending portions 66*a* are extended in the downstream direction of the upper extending portion of the conveyor belt 6 shown in FIG. 3 (left downward direction in FIG. 7), and the drum subunit 65-2 is coupled thereon. From both side faces of the lower end region of the frame 66, both ends of a developing roller supporting shaft 67 of the developing roller 16 are projected outward. At the left extending portion 66*a* a bearing hole 66*b* is formed, and at the right extending portion 66*a* a shaft receiving portion 66*c* is formed by cutting out a part of an upper face of the right extending portion 66*a*. A latch lever 66*d* is arranged at the shaft receiving portion 66*c* so as to be rotatable between an open position and a closed position through substantially 90 degrees, and it is located at the closed position to cover an upper opening of the shaft receiving portion 66*c* when it is rotated in a direction indicating by an arrow D in FIG. 7.

The drum subunit 65-2, as further shown in FIG. 4, contains the photosensitive drum 9, the initializing charging roller 12 and the cleaner 11, and the photosensitive drum 9 is rotatable and both the initializing charging roller 12 and the cleaner 11 are in contact with the peripheral face of the drum. In an upper face of the drum subunit 65-2 which is located above the photosensitive drum 9, a slit 65-2*a* is formed to extend along a rotation shaft 68 of the drum. During all of the drum units including the drum subunit 65-2 are set in their predetermined positions in the color printer 1 as shown in FIG. 3, the slit 65-2*a* is used for positioning each of the writing heads 13 attached on the upper cover 4 to the drum corresponding thereto when the writing heads 13 are lowered as indicating by the arrow Z in FIG. 4 and each of them is inserted into the slit 65-2*a* corresponding thereto. Both ends 68 of the photosensitive drum 9 are projected outward from both side faces of the drum subunit 65-2.

The drum subunit 65-2 has a protection cover 65-2*b* which is rotatable around a lower part of the outer peripheral face of the photosensitive drum 9 between a closed position and an open position, at the closed position the cover 65-2*b* covering the lower part of the outer peripheral face of the drum 9 and at the open position the cover 65-2*b* exposing the lower part toward the outside of the subunit 65-2. In order to set the drum subunit 65-2 in a predetermined position located between the two extending portions 66*a* of the developing subunit 65-1, at first the latch lever 66*d* is moved to its open position and the protection cover 65-2*b* is moved from its closed position to its open position as indicated by an arrow E in FIG. 7 to expose the lower part of the outer peripheral face of the drum 9, and then, as indicated by an arrow F in FIG. 7, the drum subunit 65-2 is arranged between the two extending portion 66*a* of the developing subunit 65-1 such that the left end of the photosensitive drum shaft 68 is inserted into the bearing hole 66*b* of the left extending portion 66*a* and the right end of the photosensitive drum shaft 68 is laid in the shaft receiving portion 66*c* of the right extending portion 66*a*. Finally, the latch lever 66*d* is moved to its closed position as indicated by the arrow D to prevent the right end of the photosensitive drum shaft 68 from falling out from the shaft receiving portion 66*c*. In this condition, the both ends of the shaft 68 are projected outward from the right and left extending portions 66*a*, and the image forming unit 65 structured by combining the developing subunit 65-1 and the drum subunit 65-2 is set in the predetermined one position in the color printer 1.

At the predetermined position of the printer 1, the left ends of the developing roller supporting shaft 67 and the photosensitive drum shaft 68 are received in a pair of shaft receiving portions 69*a*-1 and 69*a*-2 of a unit positioning block 69*a*, respectively, and the right ends of the developing roller supporting shaft 67 and the photosensitive drum shaft 68 are received in a pair of shaft receiving portions (both of which can not been shown in FIG. 6A) of another unit positioning block 69*b*. In this condition, the photosensitive drum 9*c* (9*d*) is connected at its drum gear 31*c* (31*d*) fixed at the left end of the drum to the rotation force transmission system of the printer 1, and the developing roller gear 16*a* fixed at the left end of the developing roller 16 as shown in FIG. 7 is engaged with the drum gear 31*c* (31*d*) to be transmitted a rotation force from the drum gear 31*c* (31*d*). In this embodiment, both of the drum gear 31*c* (31*d*) and the developing roller gear 16*a* are formed into helical gears to make a rotation force transmission between both of the drum gear 31*c* (31*d*) and the developing roller gear 16*a* being stable. (For the same reason, all of the first to fourth drum driving gears A1 to A4 which are engaged with the first to fourth drum gears 31*a* to 31*d* to transmit the rotation force to the drum gears as shown in FIG. 5 are also formed into helical gears.)

In this embodiment, as shown in FIGS. 6A and 6B, a suitable mark 72 such as a narrow sector shape (but it is not limited to the sector shape) is provided at a predetermined position on a flange 71 of the photosensitive drum 9*c* (9*d*), for instance to make a leading end 72*a* of the sector shaped mark 72 coincide with a peak point of an eccentric portion of the drum gear 31). A sensing hole 74 for sensing the sector shaped mark 72 is formed in a side wall of the drum subunit 65-2 which face the flange 71 of the photosensitive drum 9*c* (9*d*), at a predetermined standard position (or home position). Further, as shown in FIG. 7, three positioning holes 78*a*, 78*b*, and 78*c* are also formed in the side wall of the drum subunit 65-2, and three positioning holes 78*a*, 78*b*, and 78*c* are used when a new drum subunit 65-2 is set in the predetermined position of the developing subunit 65-1, to maintain a suitable relationship between the predetermined angular standard positions of the first to third photosensitive drums 9*a* to 9*c*.

Also, in the right extending portion 66*a* of the developing subunit 65-1, a through hole 75 is formed to face the sensing hole 74 of the drum subunit 65-2 set in the predetermined position of the developing subunit 65-1. Further in the another unit positioning block 69*b*, a through hole 76 is formed to face the through hole 75 of the right extending portion 66*a* of the developing subunit 65-1 set in the predetermined position in the printer 1. The another unit positioning block 69*b* houses a sensor 63 (or 64). In this embodiment, the sensor 63 (or 64) is a reflection type photosensor, and as shown in FIGS. 6A and 6B, the photosensor 63 (or 64) projects a light beam 77*a* from its light projecting portion to the flange 71 of the photo-sensitive drum 9*c* (9*d*) through the through hole 76 of the another unit positioning block 69*b*, the through hole 75 of the right extending portion 66*a* of the developing subunit 65-1, and the sensing hole 74 of the side wall of the drum subunit 65-2. The light beam 77*a* is reflected on the flange 71 and the reflected light beam 77*b* is directed toward a light receiving portion of the photosensor 63 (or 64) through the sensing hole 74, the through hole 75, and the through hole 76*a*, so that the photosensor 63 (or 64) senses the leading end 72*a* of the mark 72 when the photosensitive drum 9*c* (9*d*) is rotated and the leading end 72*a* comes into the sensing hole 74.

In the structure shown in FIGS. 5, 6A and 6B in order to synchronize the gears or gear units with each other in the gear train of the rotation force transmission system for the first to third drum gears 31*a* to 31*c* of the first to third photosensitive drums 31*a* to 31*c* and in the gear train of the rotation force transmission system for the fourth drum gear 31*d* of the fourth photosensitive drum 31*d* as in the one embodiment shown in FIG. 1, the gear trains of these rotation force transmission systems are rotated within a limit in which the gear trains can be rotated up to the number of the teeth corresponding to the least common multiple between the predetermined number of the teeth of the drum gear 31*c* (or 31*d*) and the predetermined number of the teeth of the third drum driving gear A3 (or the fourth drum driving gear A4). During this time, when the sensor 61 (or 62) senses the star mark of the third drum driving gear A3 (or the fourth drum driving gear A4) and at the same time the sensor 63 (or 64) senses the leading end 72*a* of the sector mark 72 on the flange 71 of the third photosensitive drum 9*c* (or the fourth photosensitive drum 9*d*), it is recognized that the third photosensitive drum 9*c* (or the fourth photosensitive drum 9*d*) is arranged at its standard position.

In this embodiment the printer 1 has two rotation force transmission systems one of which is for color printing and another of which is for monochrome printing. Therefore, on the premise that all of the first to third photosensitive drums 9*a* to 9*c* are arranged at their suitable predetermined angular positions for suitably printing a desired color image on one paper sheet on the conveyor belt 6, it will be recognized that all of the first to fourth drum driving gears A1 to A4 and all of the first to fourth drum gears 31*a* to 31*d* are set in their standard angular positions when the sensor 61 senses the star mark of the third drum driving gear A3 and at the same time the sensor 63 senses the leading end 72*a* of the sector mark 72 on the flange 71 of the third photosensitive drum 9*c*.

All of the angular positions of the first to fourth drum driving gears A1 to A4 can be easily coincided with their standard positions when the color printer 1 is assembled in a factory, but it is difficult to maintain the arrangement of all of the first to fourth photosensitive drums 9*a* to 9*d* at their suitable predetermined angular positions to suitably print a desired color image on one paper sheet on the conveyor belt 6 without a positional error of each color image. Because each of the drum subunits 65-2 can be replaced independently with new one, if do so, the arrangement of all of the first to fourth photosensitive drums 9*a* to 9*d* at their suitable predetermined angular positions for suitable color printing will not be maintained.

In order to clear this problem, three positioning holes 78*a*, 78*b*, and 78*c* are also formed in the side wall of the drum subunit 65-2 facing the flange 71 of each of the first to third photosensitive drums 9*a* to 9*c*. These positioning holes 78*a* 78*b*, and 78*c* are separated from each other at a predetermined interval in a predetermined rotation direction of the photosensitive drum 9*c* (9*d*). By only arranging the marks 72 on the flanges 71 of the first to third photosensitive drums 9*a* to 9*c* in the three positioning holes 78*a*, 78*b*, and 78*c*, respectively, the arrangement of the first to third photosensitive drums 9*a* to 9*d* at their suitable predetermined angular positions for suitable color printing can be easily attained.

In the followings, the use of the three positioning holes 78*a*, 78*b*, and 78*c* will be described. In this embodiment, the diameter of each of the photosensitive drums 9*a*, 9*b*, 9*c*, and 9*d* is D=30 mm, the length of the outer peripheral face of each of the photosensitive drums is $S=\pi D=94.2$ mm, and the distance between adjacent two photosensitive drums is L=89 mm.

Figure 9:
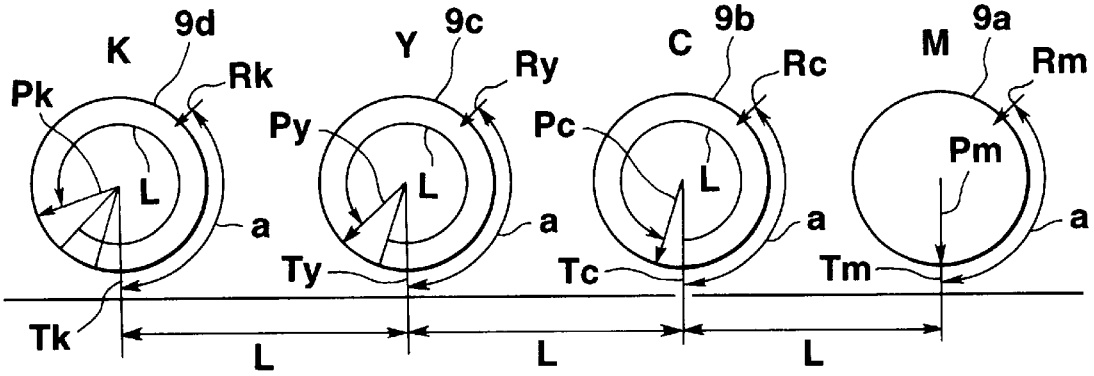
FIG. 9 is a figure describing the initial position setting for the phase fitting according to one embodiment of the present invention.

FIG. 9 shows that how to set the initial positions of the photosensitive drums 9*a*, 9*b*, 9*c*, and 9*d* to adjust phases of the photosensitive drums or to make the suitable color printing without positional error of each color image. In FIG. 9, Rm, Rc, Ry and Rk designate recording points (exposure points) on the photosensitive drums 9*a*, 9*b*, 9*c* and 9*d*, respectively. At these points, the drums are exposed by the light from the writing heads 13 (see FIG. 3). A moving distance of an eccentric peak point Pm on the photosensitive drum 9*a* (the drum gear 31*a*) is "a+L" and a time through which the eccentric peak point Pm moves for the moving distance is "(a+L)/V" (V: a peripheral speed of the photosensitive drum) while the eccentric peak point Pm is exposed at the recording point (exposing point) Rm, is developed by Magenta toner, the developed image of Magenta color on the peak point Pm is transferred to the paper sheet on the conveyor at the transfer point Tm, and finally the image of Magenta color transferred from the eccentric peak point Pm at the transfer point Tm is reached at the transfer point Tc of the photosensitive drum 9*b* for Cyan color image.

In order to meet an image exposed and developed by Cyan toner on an eccentric peak point Pc on the photosensitive drum 9*b* for Cyan color image with the image of the Magenta color transferred to the paper sheet from the eccentric peak point Pm of the photosensitive drum 9*a* for Magenta color image at a transfer point Tc of the photosensitive drum 9*b*, the eccentric peak point Pc on the photosensitive drum 9*b* must pass on an exposed point Rc for a/V minutes before than the meeting of the developed image of Cyan color on the eccentric peak point Pc on the photosensitive drum 9*b* with the image of Magenta color transferred to the paper sheet from the eccentric peak point Pm of the photosensitive drum 9*a* at the transfer point Tc of the photosensitive drum 9*b*.

Concretely, when the eccentric peak point Pm on the photosensitive drum 9*a* for the Magenta color image is reached at the transfer point Tm, the eccentric peak point Pc on the photosensitive drum 9*b* for the Cyan color image is reached at a point separated around the drum 9*b* through L=89 mm from the transfer point Tc in a direction opposite to the rotational direction of the photosensitive drum 9*b*.

Further, similarly to the above described case, in order to meet an image exposed and developed on an eccentric peak point Py on the photosensitive drum 9*c* for Yellow color image with both of the image of Magenta color transferred to the paper sheet from the eccentric peak point Pm of the photosensitive drum 9*a* and the image of Cyan color transferred to the paper sheet from the eccentric peak point Pc of the photosensitive drum 9*b*, at a transfer point Ty of the photosensitive drum 9*c* for Yellow color image, the eccentric peak point Py on the photosensitive drum 9*c* is reached at a point separated around the drum 9*c* through L=89 mm from the transfer point Ty in a direction opposite to the rotational direction of the photosensitive drum 9*c*, when the eccentric peak point Pc on the photosensitive drum 9*b* for the Cyan color image is reached at the transfer point Tc.

More further, similary to the above described two cases, in order to meet an image of Black or monochrome color exposed and developed on an eccentric peak point Pk on the photosensitive drum 9*d* with the three images, first of which is of Magenta color and transferred to the paper sheet from the eccentric peak point Pm of the photosensitive drum 9*a*, second of which is of Cyan color transferred to the paper sheet from the eccentric peak point Pc of the photosensitive drum 9*b*, and third of which is of Yellow color and transferred to the paper sheet from the eccentric peak point Py of the photosensitive drum 9*c*, at a transfer point Tk of the photosensitive drum 9*d* for Black or monochrome color image, the eccentric peak point Pk on the photo-sensitive drum 9*d* for Black or monochrome color image is reached at a point separated around the photosensitive drum 9*d* through L=89 mm from the transfer point Tk in a direction opposite to the rotational direction of the photosensitive drum 9*d*, when the eccentric peak point Py on the photosensitive drum 9*c* for the Yellow color image is reached at the transfer point Ty.

That is, if it is considered that a location of the eccentric peak point Pm of the first photosensitive drum 9*a* for Magenta color image is as a standard angular position, the eccentric peak point Pc of the second photosensitive drum 9*b* for Cyan color image must be separated from the standard angular position through the distance "πD−L" in the rotation direction of the second drum 9*b*, the eccentric peak point Py of the third photosensitive drum 9*c* for Yellow color image must be separated from an angular position corresponding to the eccentric peak point Pc of the second photosensitive drum 9*b* for Cyan color image through the distance "πD−L" in the rotation direction of the third drum 9*c*, and the eccentric peak point Pk of the fourth photosensitive drum 9*d* for Black or monochrome color image must be separated from an angular position corresponding to the eccentric peak point Py of the third photosensitive drum 9*c* for Yellow color image through the distance "πD−L" in the rotation direction of the fourth drum 9*d*. A1ternatively, the eccentric peak points Pm, Pc, Py, and Pk of the first to fourth photosensitive drums 9*a*, 9*b*, 9*c*, and 9*d* must be separated from each other by an angle of θ=360 degrees×(πD− L)/πD.

Figure 8:
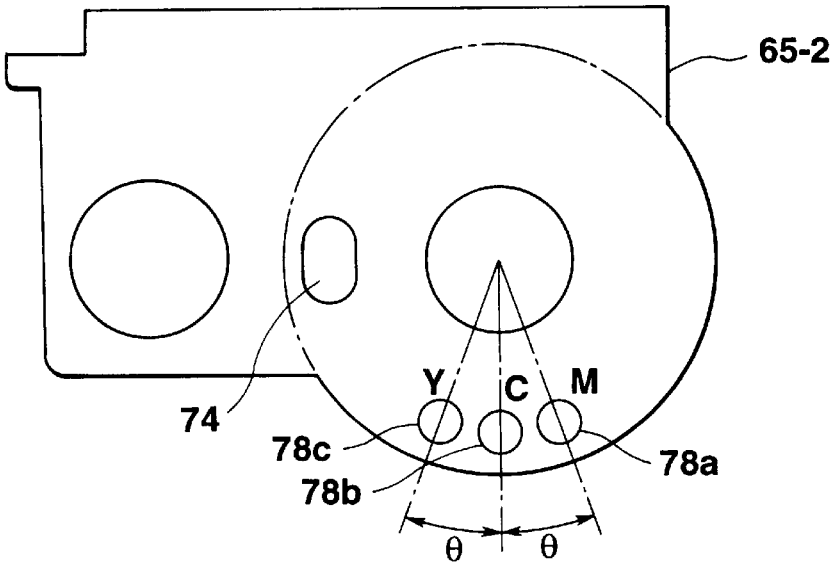
FIG. 8 is a side view of a drum unit casing with a detection hole according to one embodiment of the present invention.

As shown in FIG. 8, the three positioning holes 78*a*, 78*b*, and 78*c* formed in the side wall of the drum subunit 65-2 facing the flange 71 of each of the first to third photosensitive drums 9*a* to 9*c* are separated from each other through= 20 degrees, that is =[360 degrees×(94.2−89)/94.2]=19.87 degrees and this corresponds to 5.2 mm A=S−L in the peripheral length of each photosensitive drum.

And, when the drum subunit 65-2 provided with the first photosensitive drum 9*a* for the Magenta color image is replaced with new one, the angular position of the first photosensitive drum 9*a* of the new one must be adjusted such that the leading end 72*a* of the mark 72 on the first photosensitive drum 9*a* is arranged in the right positioning hole 78*a* before the new one is set in the predetermined position in the developing subunit 65-1 corresponding thereto. Further, when the drum subunit 65-2 provided with the second photosensitive drum 9*b* for the Cyan color image is replaced with new one, the angular position of the second photosensitive drum 9*b* of the new one must be adjusted such that the leading end 72*a* of the mark 72 on the second photosensitive drum 9*b* is arranged in the center positioning hole 78*b* before the new one is set in the predetermined position in the developing subunit 65-1 corresponding thereto. More further, when the drum subunit 65-2 provided with the third photosensitive drum 9*b* for the Yellow color image is replaced with new one, the angular position of the third photosensitive drum 9*c* of the new one must be adjusted such that the leading end 72*a* of the mark 72 on the third photosensitive drum 9*c* is arranged in the left positioning hole 78*c* before the new one is set in the predetermined position in the developing subunit 65-1 corresponding thereto.

In this embodiment, the mark 72 is mounted on the flange 71 of each of the photosensitive drums 9*a*, 9*b*, 9*c*, and 9*d*. However, the flange 71 may be omitted. And, in this case, the mark 72 may be mounted at a region on one end portion of each of the photosensitive drums 9*a*, 9*b*, 9*c*, and 9*d* , the region being located out of an image forming region on the peripheral face of each of the photosensitive drums.

As described above, since the angular positions of the photosensitive drums 9*a*, 9*b*, and 9*c* for color images with respect to the drum driving gears A1, A2, and A3 corresponding thereto can be easily adjusted, the rotation characteristics of all of the photosensitive drums 9*a*, 9*b*, 9*c*, and 9*d* can be synchronized with the rotation characteristics of all of the drum driving gears A1, A2, A3, and A4 corresponding thereto by setting a relative position between the photosensitive drum 9*c* (or 9*d*) and the drum driving gear 31*c* (or 31*d*) such that the mark 72 on the photosensitive drum 9*c* (or 9*d*) is sensed by the sensor 63 (or 64) at the same time when the sensor 61 (or 62) senses the star mark on the drum driving gear 9*c* (or 9*d*). Therefor, if each of the drum driving gears has a deflection in its rotational character, the deflection can be canceled in the gear train in the rotation force transmission system of the printer.

As described above in detail, according to the present invention, at first the positional adjustment of the one rotation force transmission system in which the change of torque caused by the change of inertia is relatively small, is performed and its movement is stopped, and then its movement is restarted when the positional adjustment of the another rotation force transmission system in which the change of torque caused by the change of inertia is relatively large, is performed during the movement of the another rotation force transmission system is continued. Therefore, the deflection of the stop position of each gear or gear unit in the rotation force transmission systems caused by the inertia thereof can be canceled by only changing control of the driving of the transmission systems not depending on a mechanical precision of the each gear or gear unit, so that the positional synchronization between the two rotation force transmission systems can be easily performed. Further, even if each of the image forming units is comprised of some subunits, the positional relationship between all of the photo-sensitive drums to perform a suitable printing of color image on the paper sheet without the positional error of each of the images of all colors, can be easily attained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An image forming apparatus which can freely be attached to and removed from a specified position in a housing including a sheet carrying passage of an image forming apparatus, along the sheet carrying passage, the image forming apparatus comprising:

an image carrier drum with a driven gear connected to a driving gear of a driving force transmission mechanism of said image forming apparatus, when mounted in said image forming apparatus and to which a mark which includes eccentricity information is applied; and a casing for surrounding and supporting the image carrier drum, wherein the casing has an opening portion therethrough for detecting said mark from a location outside of the casing.

2. The image forming apparatus according to claim 1, wherein said image forming apparatus further comprises:

a first unit which contains said image carrier drum and said casing; and a second unit attachable to the first unit, the second unit including a development means for forming a toner image on said image carrier drum and a development casing for surrounding and supporting the development means, wherein said development casing has an extending portion facing said opening portion when attached to said first unit, the extending portion including an opening for detecting said mark from outside of the extending portion corresponding to said opening portion.

3. An image forming apparatus comprising:

a driving source which generates a driving force;

first and second driving force transmission mechanisms, each driving force transmission mechanism including a train of gears driven by said driving source, one of said train of gears of each of said driving force transmission mechanisms having a reference mark thereon;

a driving force transmission control mechanism operatively coupled to said first driving force transmission mechanism, said driving force transmission control mechanism selectively either transmitting or cutting-off the driving force of said driving source to said first driving force transmission mechanism;

a first detector which detects the reference mark on the gear of said first driving force transmission mechanism to output a first control signal;

a second detector which detects the reference mark on the gear of said second driving force transmission mechanism to output a second control signal; and a position adjustment controller which receives the first and second control signals from said first and second detectors, and which controls said driving force transmission control mechanism to either drive or stop said first driving force transmission mechanism while said second driving force transmission mechanism is driven, such that a rotational positioning relationship between said first and second driving force transmission mechanisms is kept constant.

4. An image forming apparatus which is housed in a housing in which a sheet conveying passage is provided, the image forming apparatus comprising:

a plurality of image carrier drums arranged side by side at a plurality of predetermined positions along the sheet conveying passage in the housing, the plurality of image carrier drums being respectively provided with driven gears, each of the driven gears having the same shape;

a first driving force transmission mechanism including a driving gear engaged with the driven gear of a predetermined one of said image carrier drums, the driving gear being provided with a reference mark including eccentricity information;

a second driving force transmission mechanism including a plurality of driving gears engaged with the driving gears of the other image carrier drums, at least one of the driving gears being provided with a reference mark including eccentricity information, the driving gears of said first and second driving force transmission mechanism having the same shape;

a driving source which generates a driving force and which transmits the driving force to the first and second driving force transmission mechanisms;

a driving force shifter which has a first mode in which the driving force of said driving source is transmitted to said first driving force transmission mechanism, and a second mode in which the driving force of said driving source is transmitted to both of said first and second driving force transmission mechanisms;

a first detector which detects the reference mark on the driving gear of said first driving force transmission mechanism and determines a home position of the driving gear of said first driving force transmission mechanism;

a second detector which detects the reference mark on the at least one of said driving gears of said second driving force transmission mechanism and determines a home position of the at least one of said driving gears of said second driving force transmission mechanism;

a first image forming unit which forms an image on the predetermined one of said image carrier drums;

a second image forming unit which forms an image on at least one of the other image carrier drums;

an image formation controller which causes said first image forming unit to form an image on the predetermined one of said image carrier drums when said driving force shifter is set in the first mode, and causes said first and second image forming units to form images on the predetermined one of the other image carrier drums and on the at least one of the other image carrier drums when said driving force shifter is set in the second mode; and a driving force transmission mechanism controller which initially brings said driving force shifter to said second mode to transmit the driving force of said driving source to said first and second driving force transmission mechanisms, secondarily brings said driving force shifter to said first mode in response to the determination of the home position of the at least one of said driving gears of said second driving force transmission mechanism by said second detector and to transmit the driving force of said driving source to said first driving force transmission mechanism, and which lastly brings said driving force shifter to said second mode in response to the determination of the home position of the driving gear of said first driving force transmission mechanism by said first detector and to transmit the driving force of said driving source to said first and second driving force transmission mechanisms, wherein a rotational positioning relationship between said first and second driving force transmission mechanisms becomes constant to make said first and second image forming units form an image on the predetermined one of said image carrier drums and at least one image on the at least one of the other image carrier drums such that the images can be transferred onto predetermined positions without forming a positional sift on a sheet from the predetermined one of said image carrier drums and the at least one of the other image carrier drums while the sheet is conveyed in the sheet conveying passage.

5. An image forming apparatus according to claim 4, wherein a mark is provided on said driven gear of the predetermined one of said image carrier drums, and a mark is provided on said driven gear of the at least one of the other image carrier drums, and said image forming apparatus further comprises:

a first driven gear detector which detects the mark on said driven gear of the predetermined one of said image carrier drums and determines a home position of said driven gear of the predetermined one of said image carrier drums; and a second driven gear detector which detects the mark on said driven gear of the at least one of the other image carrier drums and determines a home position of said driven gear of the at least one of the other image carrier drums;

wherein said driving force transmission mechanism controller determines that:

a reference position of said second driving force transmission mechanism has been detected when the determination of the home position of the at least one of said driving gears of said second driving force transmission mechanism by said second detector coincides with the determination of the home position of said driven gear of the at least one of the other image carrier drums by said second driven gear detector, while said driving force transmitting mechanism controller firstly brings said driving force shifter to said second mode and the driving of said first and second driving force transmission mechanisms is continued within a least common denominator of the number of teeth of one of the driving gears of said second driving force transmission mechanism and the number of teeth of one of the driven gears of the other image carrier drums, and a reference position of said first driving force transmission mechanism has been detected when the determination of the home position of said driving gear of said first driving force transmission mechanism by said first detector coincides with the determination of the home position of said driven gear of the predetermined one of said image carrier drums by said first driven gear detector, while said driving force transmitting mechanism controller secondarily brings said driving force shifter to said first mode and the driving of said first driving force transmission mechanism is continued within the least common denominator of the number of teeth of the driving gear of said first driving force transmission mechanism and the number of teeth of the predetermined one of said driven gears of the image carrier drums.

6. An image forming apparatus according to claim 4, further comprising a plurality of casings which hold the plurality of image carrier drums respectively so as to form a plurality of image forming units in each of which a desired image can be formed on each image carrier drum, each image forming unit being able to move between a working position where each image carrier drum is arranged at a predetermined position along the sheet conveying passage in the housing and non-working position where each image carrier drum is separated from the predetermined position along the sheet conveying passage in the housing.

7. An image forming apparatus according to claim 4, wherein said driving gears of said first and second driving force transmission mechanisms and said driven gears of said image carrier drums comprise of helical gears.

8. An image forming apparatus according to claim 4, further comprising a plurality of image forming units arranged side by side in the housing at a plurality of specified positions along the sheet carrying passage, and said mark being provided on said driven gear of said image carrier drum of each of two image forming units and being used to detect a home position of said driven gear of said image carrier drum of each of the two image forming units so that the driven gears of said image carrier drums of said image forming units are arranged in a specified relationship.

9. An image forming apparatus according to claim 8, wherein the driving force transmission mechanism has a plurality of driving gears each of which is connected to said driven gear of said image carrier drum of each image forming unit when said plurality of image forming units are arranged at the plurality of specified positions, and each of said driven gears and each of said driving gears include helical gears.

* * * * *